US008678876B2

(12) United States Patent
Persaud et al.

(10) Patent No.: US 8,678,876 B2
(45) Date of Patent: Mar. 25, 2014

(54) METHOD AND APPARATUS FOR REMOTE CONTROLLED OBJECT GAMING WITH PROXIMITY-BASED AUGMENTED REALITY ENHANCEMENT

(75) Inventors: Anthony G. Persaud, San Diego, CA (US); Adrian J. Prentice, San Diego, CA (US); George Joseph, San Diego, CA (US); Mark R. Storch, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 13/274,570

(22) Filed: Oct. 17, 2011

(65) Prior Publication Data

US 2012/0302129 A1 Nov. 29, 2012

Related U.S. Application Data

(60) Provisional application No. 61/488,899, filed on May 23, 2011.

(51) Int. Cl.
*A63H 30/00* (2006.01)

(52) U.S. Cl.
USPC ..... 446/454; 446/456

(58) Field of Classification Search
USPC ..... 446/454
See application file for complete search history.

(56) References Cited

U.S. PATENT DOCUMENTS

| | | | | |
|---|---|---|---|---|
| 6,171,172 | B1 * | 1/2001 | Foster et al. | 446/441 |
| 7,391,320 | B1 | 6/2008 | Beard et al. | |
| 7,592,956 | B2 | 9/2009 | McPherson et al. | |
| 7,744,441 | B2 * | 6/2010 | Sosnovskiy | 446/175 |
| 2001/0031652 | A1 * | 10/2001 | Gabai et al. | 463/1 |
| 2002/0137427 | A1 * | 9/2002 | Peters et al. | 446/454 |
| 2003/0082987 | A1 * | 5/2003 | Baumgartner et al. | 446/175 |
| 2003/0174085 | A1 * | 9/2003 | Gavish et al. | 341/176 |
| 2004/0192159 | A1 * | 9/2004 | Armstrong et al. | 446/175 |
| 2006/0223637 | A1 * | 10/2006 | Rosenberg | 463/47 |
| 2007/0063834 | A1 * | 3/2007 | Bozzone et al. | 340/539.1 |
| 2008/0027591 | A1 | 1/2008 | Lenser et al. | |
| 2010/0203933 | A1 * | 8/2010 | Eyzaguirre et al. | 463/2 |

FOREIGN PATENT DOCUMENTS

WO 9624120 A1 8/1996

OTHER PUBLICATIONS

Alriksson, P. et al., "Experimental Evaluation of a Distributed Kalman Filter Algorithm," 2007 46th IEEE Conference on Decision and Control, pp. 5499-5504, Dec. 12-14, 2007. See Part A.

International Search Report and Written Opinion—PCT/US2012/027599—ISA/EPO—Apr. 27, 2012.

* cited by examiner

*Primary Examiner* — Tramar Harper
(74) *Attorney, Agent, or Firm* — Paul S. Holdaway

(57) ABSTRACT

Apparatuses for remote control by a remote object is disclosed that includes one or more sensors configured to communicate with the remote object to obtain ranging information of the apparatus relative to the remote object; and a processing system configured to provide local control of the apparatus based on the ranging information.

47 Claims, 6 Drawing Sheets

METHOD AND APPARATUS FOR REMOTE CONTROLLED OBJECT GAMING WITH PROXIMITY-BASED AUGMENTED REALITY ENHANCEMENT

PRIORITY CLAIM

This application claims the benefit of U.S. Provisional Patent application Ser. No. 61/488,899, entitled "METHOD AND APPARATUS FOR REMOTE CONTROLLED OBJECT GAMING WITH PROXIMITY-BASED AUGMENTED REALITY ENHANCEMENT", which was filed May 23, 2011. The entirety of the aforementioned application is herein incorporated by reference.

BACKGROUND

1. Field

Certain aspects of the disclosure set forth herein generally relate to augmented reality gaming, and more specifically, to a method and apparatus for remotely controlled object gaming with proximity-based augmented reality enhancement.

2. Background

Current radio controlled (RC) vehicles have not been modernized to utilize the latest technology that has been adopted for computing devices such as smartphones. For example, current solutions that adopt the use of smartphones as controllers for remote vehicles tend to quickly drain battery power, suffer from interference issues, and may only be able to implement a reduced set of commands due to limited data transfer rates.

Consequently, it would be desirable to address the issues noted above.

SUMMARY

In one aspect of the disclosure, an apparatus for remote control by a remote object includes one or more sensors configured to communicate with the remote object to obtain ranging information of the apparatus relative to the remote object; and a processing system configured to provide local control of the apparatus based on the ranging information.

In another aspect of the disclosure, an apparatus for remote control by a remote object includes one or more means for sensing configured to communicate with the remote object to obtain ranging information of the apparatus relative to the remote object; and a means for processing configured to provide local control of the apparatus based on the ranging information.

In yet another aspect of the disclosure, a method for remote control of an apparatus by a remote object includes communicating with the remote object to obtain ranging information of the apparatus relative to the remote object; and providing local control of the apparatus based on the ranging information.

In yet another aspect of the disclosure, a computer program product for remote control of an apparatus by a remote object includes a computer-readable medium comprising instructions executable for communicating with the remote object to obtain ranging information of the apparatus relative to the remote object; and providing local control of the apparatus based on the ranging information.

In yet another aspect of the disclosure, a remote control vehicle for remote control by a remote object includes at least one antenna; one or more sensors configured to communicate with the remote object to obtain ranging information of the remote control vehicle relative to the remote object; and a processing system configured to provide local control of the remote control vehicle based on the ranging information.

BRIEF DESCRIPTION OF THE DRAWINGS

So that the manner in which the above-recited features of the disclosure set forth herein can be understood in detail, a more particular description, briefly summarized above, may be had by reference to aspects, some of which are illustrated in the appended drawings. It is to be noted, however, that the appended drawings illustrate only certain typical aspects of this disclosure and are therefore not to be considered limiting of its scope, for the description may admit to other equally effective aspects.

DETAILED DESCRIPTION

Figure 1:
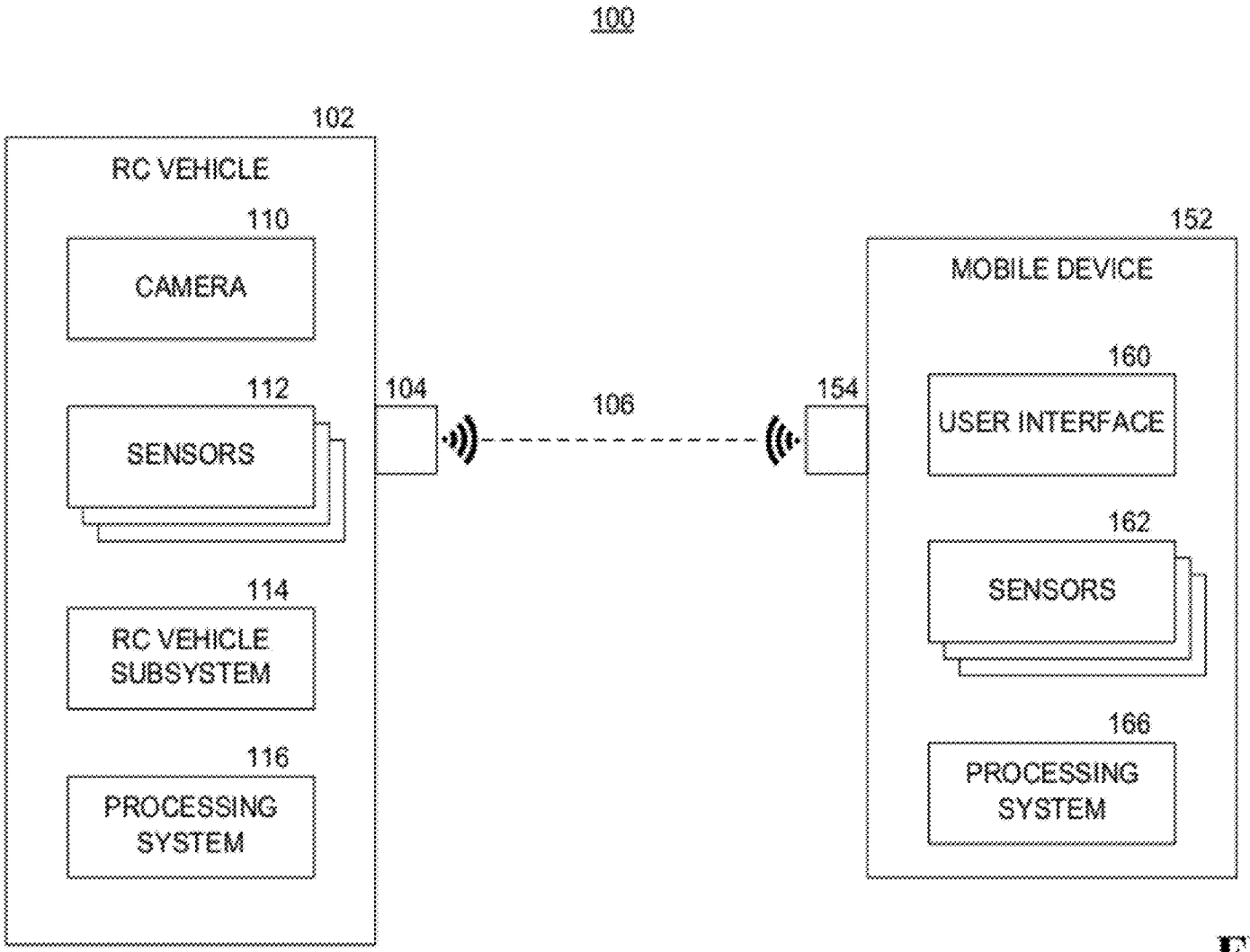
FIG. 1 is a diagram illustrating an example of a remote controlled object gaming system with proximity-based augmented reality enhancement in accordance with certain aspects of the disclosure set forth herein.

Various aspects of the disclosure are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the disclosure disclosed herein, whether implemented independently of or combined with any other aspect of the disclosure. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the various aspects of the disclosure set forth herein. It should be understood that any aspect of the disclosure disclosed herein may be embodied by one or more elements of a claim.

The word "exemplary" is used herein to mean "serving as an example, instance, or illustration." Any aspect described herein as "exemplary" is not necessarily to be construed as preferred or advantageous over other aspects. Further, although particular aspects are described herein, many variations and permutations of these aspects fall within the scope of the disclosure. Although some benefits and advantages of the preferred aspects are mentioned, the scope of the disclosure is not intended to be limited to particular benefits, uses, or objectives. Rather, aspects of the disclosure are intended to be broadly applicable to different wireless technologies, system configurations, networks, and transmission protocols, some of which are illustrated by way of example in the figures and in the following description of the preferred aspects. The detailed description and drawings are merely illustrative of the disclosure rather than limiting, the scope of the disclosure being defined by the appended claims and equivalents thereof.

Current radio controlled (RC) vehicles have not been modernized to utilize the latest technology that has been adopted for computing devices such as smartphones. For example, current solutions that adopt the use of smartphones as controllers for remote vehicles tend to quickly drain battery power, suffer from interference issues, and may only be able to implement a reduced set of commands due to limited data transfer rates.

The disclosed approach includes the integration of proximity sensors in RC vehicles to provide ranging and proximity information to the augmented reality game play when two or more vehicles are present. The disclosed approach also includes a high capacity data channel that can be used to communicate control and media data for the vehicle from a remote control.

In one aspect, an approach of utilizing proximity sensors to enable remote management of vehicles and devices through a mobile device is set forth herein. One method includes providing the mobile device with one or more proximity sensors that can interact with the proximity sensors on the vehicle to be controlled. The mobile device may also include one or more other sensors. As a user manipulates the mobile device, the embedded sensors recognize different gestures and send them to a processing system on the mobile device. The processing system may process the gestures as commands and wirelessly relays these gestures and commands to the remote vehicles, which allow the user to coordinate the actions of that vehicle, such as steering, accelerating, etc.

The use of the proximity sensors offers a high data channel that can also be used to stream video from a mounted camera on the RC vehicle while still being able to send directional and controls signals to the device. The proximity sensors provide a much lower power usage signature that allows users to play longer with their vehicles. Current solutions utilize WiFi, which consume battery power at a much higher rate, increasing recharge times. The proximity sensors could work together to provide proximity data between vehicles in order to augment gameplay mechanics (e.g., tag, shooting virtual objects). The use of the proximity sensors as a radio control channel provides for a much simpler setup for consumers without the requirement of setting up a cumbersome Ad-Hoc WiFi network.

The disclosed approach does not require the use of a motion capture camera and is not affected by external interference since the proximity sensors described herein uses a high frequency band not used by Wi-Fi or cell phones. Further, the proximity sensors described herein utilize extremely low power, which allow for longer external use with battery systems. The use of multiple channels provides ample transfer rate for the most data intensive proximity data. The use of a mesh of proximity sensors to create a virtual pillar area in which users can perform an unlimited number of motions that can be captured as gestures and understood as commands.

The teachings herein may be incorporated into, implemented within, or performed by, a variety of wired or wireless apparatuses, or nodes. In some aspects, a wireless node implemented in accordance with the teachings herein may comprise a body-mounted node, a stationary estimator node, an access point, an access terminal, etc. Certain aspects of the disclosure set forth herein may support methods implemented in body area networks (BANs).

FIG. 1 illustrates an RC system 100 with proximity-based augmented reality enhancement that includes an RC vehicle 102 and a mobile device 152. The RC vehicle 102 includes a transceiver 104 that communicates data provided wirelessly with a transceiver 154 on in the mobile device 152. The transceiver 104 and the transceiver 154 may include an antenna to provide a farther range of communication. In one aspect of the RC system 100, the proximity data that is communicated is encapsulated in a wireless protocol 106. The RC vehicle 102 further includes a camera 110, a plurality of sensors 112, and an RC vehicle subsystem 114. The camera 102 is used to captured images and/or video data that is transmitted to the mobile device 152 and displayed as explained further herein.

The RC vehicle 102 includes an RC vehicle subsystem 114 that includes a variety of circuits, servos and motors that is typically found in an RC vehicle. For example, the RC vehicle subsystem 114 will typically include a steering mechanism that is controlled by one or more electromechanical servos. Further, the RC vehicle subsystem 114 will typically include one or more drive motors to propel the vehicle. One of ordinary skill in the art will be familiar with the elements of the RC vehicle subsystem 114, including any battery/power systems necessary to power all the parts of the RC vehicle 102. The RC vehicle 102, although described mainly assuming a RC car, may also be a plane, a boat, a submarine, or any other RC object.

Both the RC vehicle 102 and the mobile device 152 include a plurality of sensors 112 and 162, respectively, which may be any number of proximity sensors depending on requirements of a particular implementation. Each of these proximity sensors, also referred to as nodes, may range with another node. Thus, the proximity sensors in the RC vehicle 102 and the mobile device 152 may communicate with each other to determine ranging information between the RC vehicle 102 and the mobile device 152. In addition, the proximity sensors may provide the functionality provided by the wireless transceiver 104 on the RC vehicle 102 and the wireless transceiver 154 on the mobile device 152. In one aspect of the RC system 100, the RC vehicle 102 is programmed to perform certain actions when the ranging information from the proximity sensors indicates that the RC vehicle 102 is no longer in range of the mobile device 152. For example, the RC vehicle 102 may be programmed to determine when the range between itself and the mobile device 152 is above a particular threshold. This threshold would generally be at the range where communication would be lost between the RC vehicle 102 and the mobile device 152. Typically, in prior art systems, a mobile device has to be brought into range of communication of the RC vehicle, such as by a user holding the mobile device, which may not be possible if the RC vehicle continues moving further away because the last command the RC vehicle received was to move in that direction. Here, the RC vehicle is programmed to take local control and modify its position by reverse the direction in which it was travelling to bring itself back in range, where remote control is once again resumed. In another aspect, where the RC vehicle 102 is a plane, the RC vehicle 102 may be programmed to start turning or looping so that the RC vehicle 102 will turn back or a stationary pattern may be established. In another aspect, where the RC vehicle 102 is a watercraft, the RC vehicle 102 may reverse its direction or start turning. Other actions may be performed based on the vehicle type and specific needs of the implementation.

The plurality of sensors 112 and 162 may also include inertial, acceleration, gyroscopic or other sensors. For example, the plurality of sensors 162 on the mobile device 152 may include one or more of the aforementioned sensors to detect the tilting of the mobile device 152 to allow the user to simulate steering the RC vehicle 102. Similarly, the plurality of sensors 102 for the RC vehicle 102 may include one or more of the aforementioned sensors to determine the acceleration of the vehicle.

Both the RC vehicle 102 and the mobile device 152 also include a processing system 116 and a processing system 166, respectively. The processing systems provide the functionality required to process data and implement the functionalities described herein. Although one of ordinary skill in the art should be familiar with implementing the processing systems, such as using various memories and processors and interconnecting busses, these will be further described in general below.

The transceivers on each device will communicate the data from the other device and process the ranging information using the processing system 116 and a processing system 166, respectively. Further, data received from the wireless transceiver 154 may also contain processed information, such as gesture or movement information detected from the movements of the body of the user as described herein. Further still, the wireless transmitter 154 may generate and transmit control and command information signals based on the gesture and movement information detected as described herein.

Figure 2:
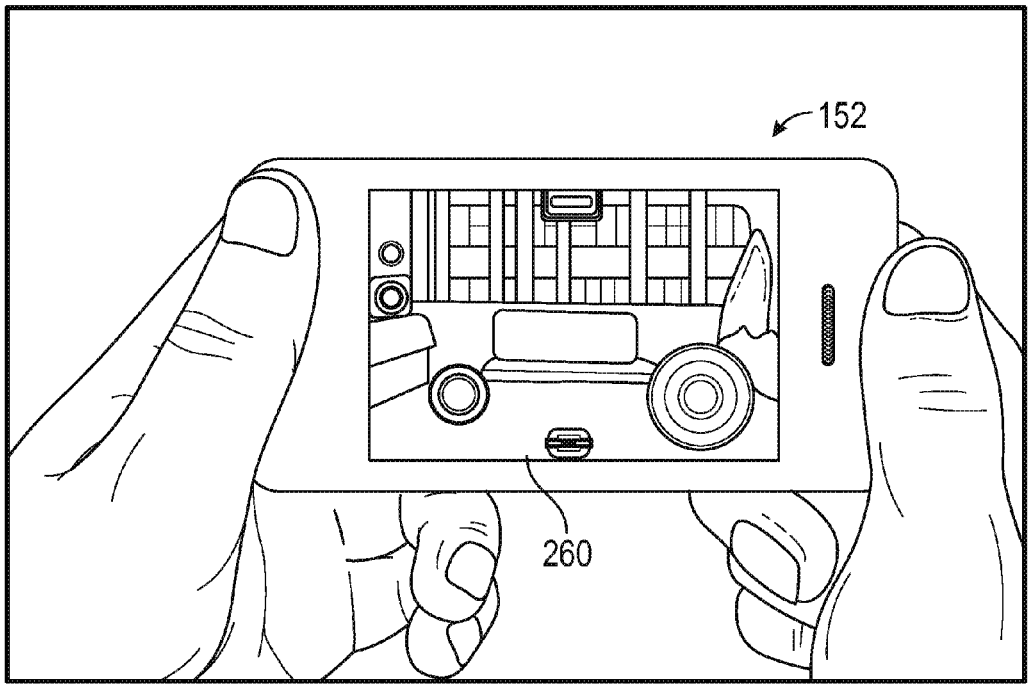
FIG. 2 is a diagram illustrating an aspect of the remote controlled object gaming system of FIG. 1 in accordance with certain aspects of the disclosure set forth herein.
Figure 2:
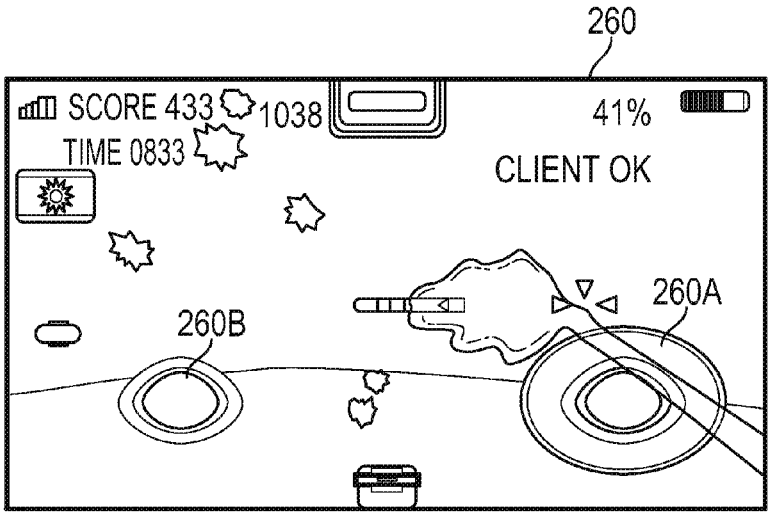

Continuing to refer to FIG. 1, and now referring to FIG. 2, the mobile device 152 includes a user interface 160, with a specific example shown as a display 260. The user interface 160 may augment the controls offered through the use of the plurality of sensors 162. For example, the screen display 260 may be a touch screen that displays a plurality of on-screen buttons 260A and 260B that allow the user to provide commands. The mobile device 152 may include physical buttons that are separate from the display 260. The display 260 may also display the images and/or videos captured by the camera 110 in the RC vehicle 102, and be integrated with images and/or videos superimposed therewith on the mobile device 152.

Figure 3:
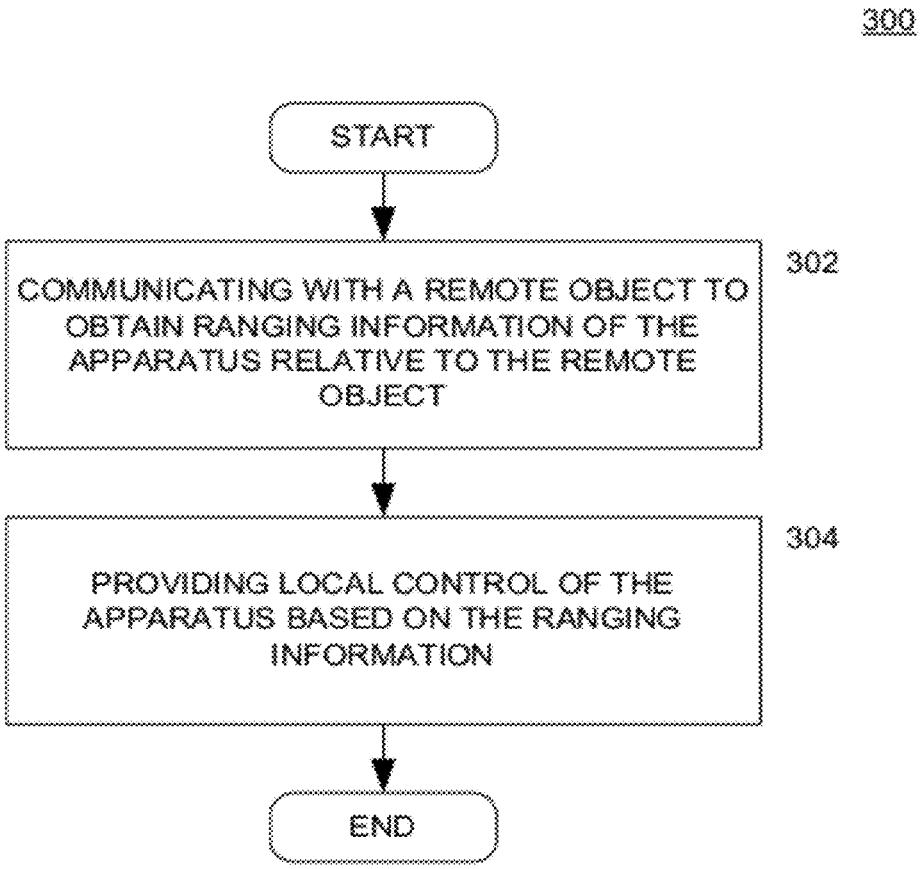
FIG. 3 is a flow diagram illustrating a remote controlled object gaming operation in accordance with certain aspects of the disclosure set forth herein.

FIG. 3 illustrates a remote object management/remote control process 300 performed by the RC vehicle 102 where at 302 ranging information is obtained by communicating with a remote object such as the mobile device 152. The ranging information is relative of the RC vehicle 102 to the remote object. At 304, providing local control of the apparatus based on the ranging information.

Figure 4:
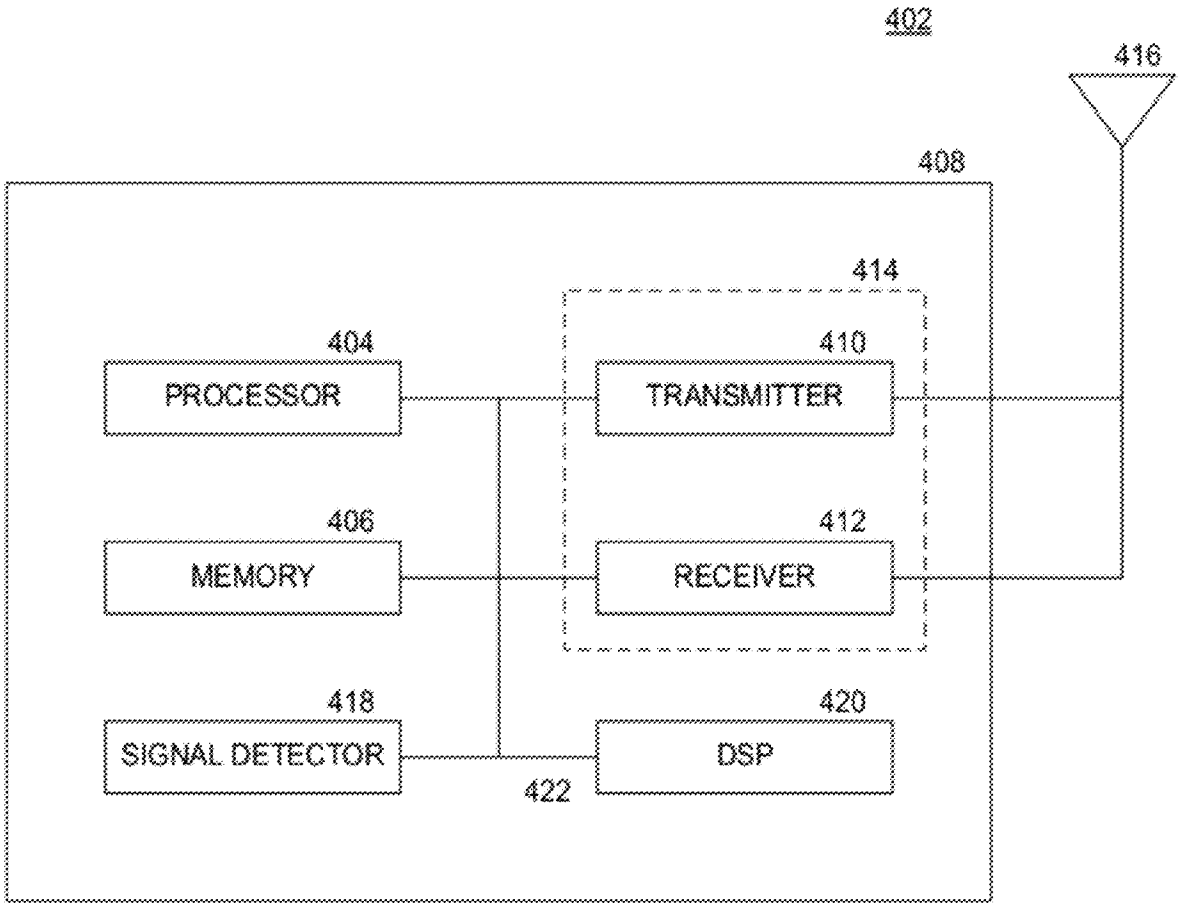
FIG. 4 is a block diagram illustrating various components that may be utilized in a wireless device of the remote controlled object gaming system in accordance with certain aspects of the disclosure set forth herein.

FIG. 4 illustrates various components that may be utilized in a wireless device (wireless node) 400 that may be employed within the system from FIG. 1. The wireless device 400 is an example of a device that may be configured to implement the various methods described herein. The wireless device 400 may be used to implement any one of the proximity sensors 112, 162. The wireless device 400 may also be used to implement the relevant parts of the RC vehicle 102 or mobile device 152.

The wireless device 400 may include a processor 404 which controls operation of the wireless device 400. The processor 404 may also be referred to as a central processing unit (CPU). Memory 406, which may include both read-only memory (ROM) and random access memory (RAM), provides instructions and data to the processor 404. A portion of the memory 406 may also include non-volatile random access memory (NVRAM). The processor 404 typically performs logical and arithmetic operations based on program instructions stored within the memory 406. The instructions in the memory 406 may be executable to implement the methods described herein.

The wireless device 400 may also include a housing 408 that may include a transmitter 410 and a receiver 412 to allow transmission and reception of data between the wireless device 400 and a remote location. The transmitter 410 and receiver 412 may be combined into a transceiver 414. An antenna 416 may be attached to the housing 408 and electrically coupled to the transceiver 414. The wireless device 400 may also include (not shown) multiple transmitters, multiple receivers, multiple transceivers, and/or multiple antennas.

The wireless device 400 may also include a signal detector 418 that may be used in an effort to detect and quantify the level of signals received by the transceiver 414. The signal detector 418 may detect such signals as total energy, energy per subcarrier per symbol, power spectral density and other signals. The wireless device 400 may also include a digital signal processor (DSP) 420 for use in processing signals.

The various components of the wireless device 400 may be coupled together by a bus system 422, which may include a power bus, a control signal bus, and a status signal bus in addition to a data bus.

In many current systems, mobile body tracking may employ inertial sensors mounted to a body associated with the BAN. These systems may be limited in that they suffer from limited dynamic range and from the estimator drifts that are common with inertial sensors. Also, acceptable body motion estimation may require a large number of sensor nodes (e.g., a minimum of 15), since each articulated part of the body may require a full orientation estimate. Further, existing systems may require the performance of industrial grade inertial sensors, increasing cost, etc. For many applications, ease of use and cost are typically of the utmost importance. Therefore, it is desirable to develop new methods for reducing the number of nodes required for mobile body tracking while maintaining the required accuracy.

In various aspects of the disclosure set forth herein, ranging is referred to in various implementations. As used herein, ranging is a sensing mechanism that determines the distance between two ranging detection equipped nodes such as two proximity sensors. The ranges may be combined with measurements from other sensors such as inertial sensors to correct for errors and provide the ability to estimate drift components in the inertial sensors. According to certain aspects, a set of body mounted nodes may emit transmissions that can be detected with one or more stationary ground reference nodes. The reference nodes may have known position, and may be time synchronized to within a fraction of a nanosecond. However, having to rely on solutions utilizing stationary ground reference nodes may not be practical for many applications due its complex setup requirements. Therefore, further innovation may be desired.

Certain aspects of the disclosure set forth herein support various mechanisms that allow a system to overcome the limitations of previous approaches and enable products that have the characteristics required for a variety of applications.

It should be noted that while the term "body" is used herein, the description can also apply to capturing pose of machines such as robots. Also, the presented techniques may apply to capturing the pose of props in the activity, such as swords/shields, skateboards, racquets/clubs/bats.

As discussed herein, inertial sensors as described herein include such sensors as accelerometers, gyros or inertial measurement units (IMU). IMUS are a combination of both accelerometers and gyros. The operation and functioning of these sensors are familiar to those of ordinary skill in the art.

Ranging is a sensing mechanism that determines the distance between two equipped nodes. The ranges may be combined with inertial sensor measurements into the body motion estimator to correct for errors and provide the ability to estimate drift components in the inertial sensors. According to certain aspects, a set of body mounted nodes may emit transmissions that can be detected with one or more stationary ground reference nodes. The reference nodes may have known position, and may be time synchronized to within a fraction of a nanosecond. However, as noted previously, this system may not be practical for a consumer-grade product due its complex setup requirements. Therefore, further innovation may be desired.

In one aspect of the disclosed system, range information associated with the body mounted nodes may be produced based on a signal round-trip-time rather than a time-of-arrival. This may eliminate any clock uncertainty between the two nodes from the range estimate, and thus may remove the requirement to synchronize nodes, which may dramatically simplify the setup. Further, the proposed approach makes all nodes essentially the same, since there is no concept of "synchronized nodes" versus "unsynchronized nodes".

The proposed approach may utilize ranges between any two nodes, including between different body worn nodes. These ranges may be combined with inertial sensor data and with constraints provided by a kinematic body model to estimate body pose and motion. Whereas the previous system performed ranging only from a body node to a fixed node, removing the time synch requirement may enable to perform ranging between any two nodes. These additional ranges may be very valuable in a motion tracking estimator due to the additional range data available, and also due to the direct sensing of body relative position. Ranges between nodes on different bodies may be also useful for determining relative position and pose between the bodies.

With the use of high-accuracy round trip time ranges and ranges between nodes both on and off the body, the number and quality of the inertial sensors may be reduced. Reducing the number of nodes may make usage much simpler, and reducing the required accuracy of the inertial sensors may reduce cost. Both of these improvements can be crucial in producing a system suitable for consumer products.

Figure 5:
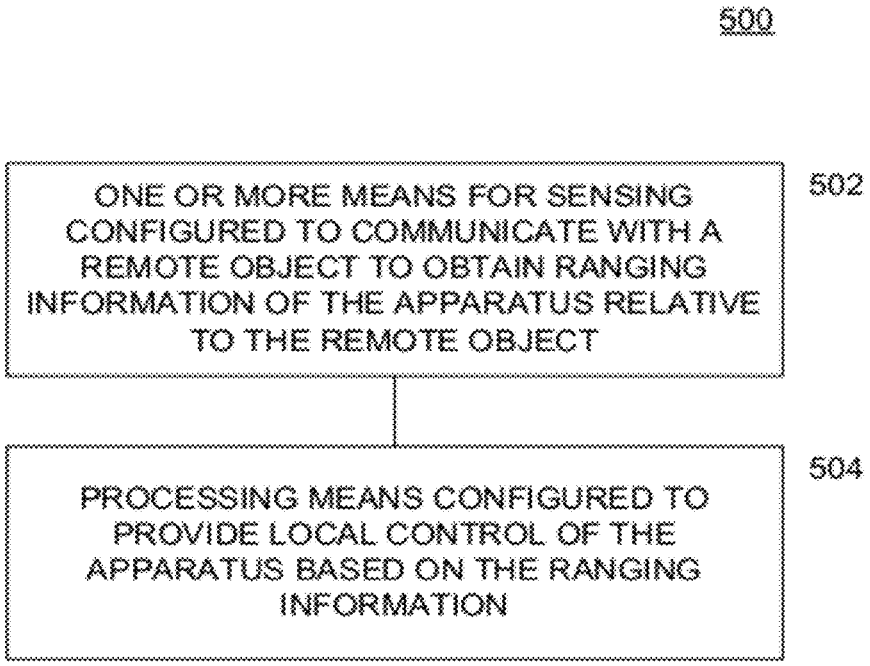
FIG. 5 is a diagram illustrating example means capable of performing the operations shown in FIG. 3.

The various operations of methods described above may be performed by any suitable means capable of performing the corresponding functions. The means may include various hardware and/or software component(s) and/or module(s), including, but not limited to a circuit, an application specific integrated circuit (ASIC), or processor. Generally, where there are operations illustrated in figures, those operations may have corresponding counterpart means-plus-function components with similar numbering. For example, FIG. 5 illustrating an example of an apparatus 500 for remote control by a remote object. The apparatus 500 includes one or more sensor means 502 configured to communicate with the remote object to obtain ranging information of the apparatus relative to the remote object; and processing means 504 configured to provide local control of the apparatus based on the ranging information.

Further, in general, a means for sensing may include one or more proximity sensors such as one or more proximity sensors, inertial sensors, or any combinations thereof in the plurality of sensors 112 and the plurality of sensors 162. A means for transmitting may comprise a transmitter (e.g., the transmitter unit 410) and/or an antenna 416 illustrated in FIG. 4. Means for receiving may comprise a receiver (e.g., the receiver unit 412) and/or an antenna 416 illustrated in FIG. 4. Means for processing, means for determining, or means for using may comprise a processing system, which may include one or more processors, such as the processor 404 illustrated in FIG. 4.

Figure 6:
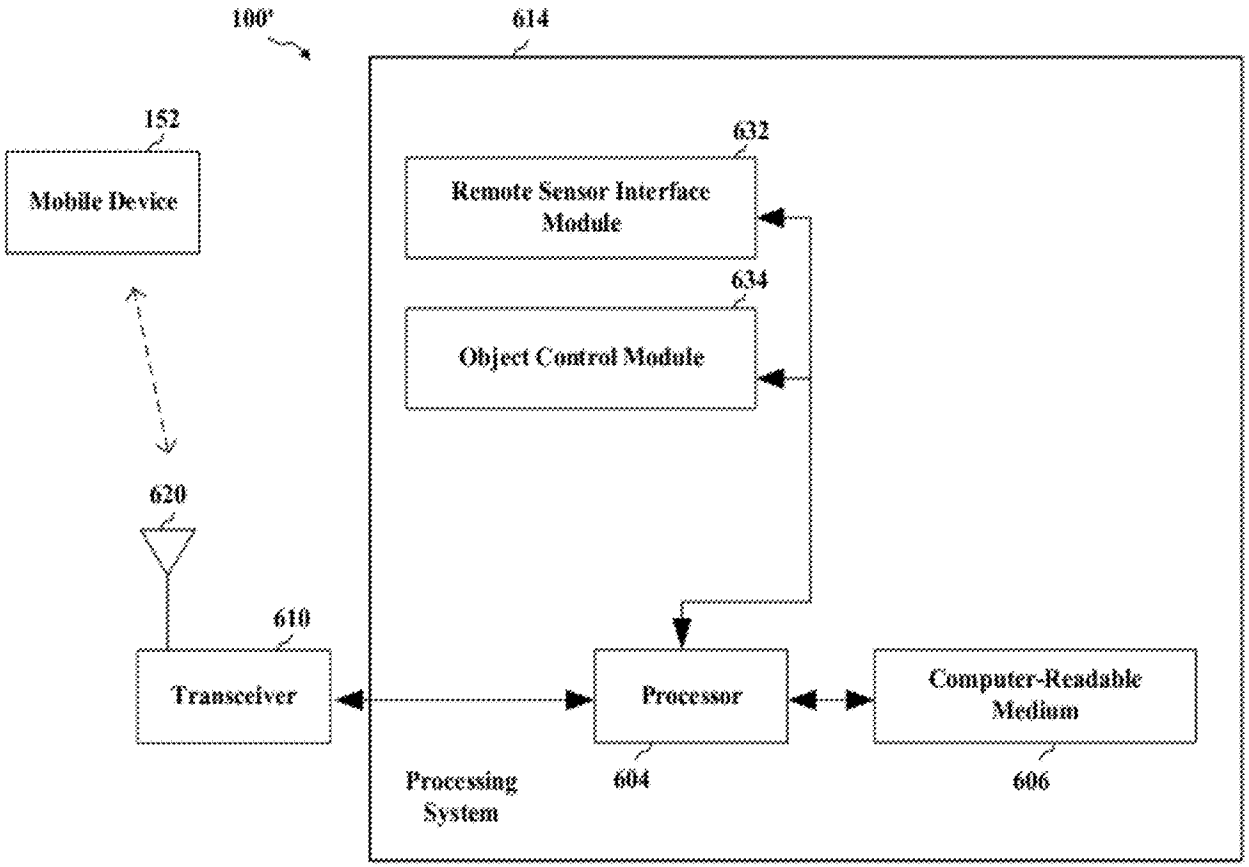
FIG. 6 is a diagram illustrating an example of a hardware implementation for an apparatus employing a processing system that may be implemented for remote controlled object gaming with proximity-based augmented reality enhancement.

FIG. 6 is a diagram illustrating an example of a hardware implementation for an object to be controlled, such as the RC vehicle 100, employing a processing system 614. The apparatus includes a processing system 614 coupled to a transceiver 610. The transceiver 610 is coupled to one or more antennas 620. The transceiver 610 provides a means for communicating with various other apparatus over a transmission medium. The processing system 614 includes a processor 604 coupled to a computer-readable medium 606. The processor 604 is responsible for general processing, including the execution of software stored on the computer-readable medium 606. The software, when executed by the processor 604, causes the processing system 614 to perform the various functions described supra for any particular apparatus. The computer-readable medium 606 may also be used for storing data that is manipulated by the processor 604 when executing software. The processing system further includes a module 632 for communicating with a remote object, such as the mobile device 152, to obtain ranging information relative to the remote object and a module 634 for providing local control of the object to be controlled based on the ranging information. The modules may be software modules running in the processor 604, resident/stored in the computer readable medium 606, one or more hardware modules coupled to the processor 604, or some combination thereof.

As used herein, the term "determining" encompasses a wide variety of actions. For example, "determining" may include calculating, computing, processing, deriving, investigating, looking up (e.g., looking up in a table, a database or another data structure), ascertaining and the like. Also, "determining" may include receiving (e.g., receiving information), accessing (e.g., accessing data in a memory) and the like. Also, "determining" may include resolving, selecting, choosing, establishing, and the like.

The various illustrative logical blocks, modules and circuits described in connection with the disclosure set forth herein may be implemented or performed with a general purpose processor, a digital signal processor (DSP), an application specific integrated circuit (ASIC), a field programmable gate array signal (FPGA) or other programmable logic device (PLD), discrete gate or transistor logic, discrete hardware components or any combination thereof designed to perform the functions described herein. A general purpose processor may be a microprocessor, but in the alternative, the processor may be any commercially available processor, controller, microcontroller or state machine. A processor may also be implemented as a combination of computing devices, e.g., a combination of a DSP and a microprocessor, a plurality of microprocessors, one or more microprocessors in conjunction with a DSP core, or any other such configuration.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims. The steps of a method or algorithm described in connection with the disclosure set forth herein may be embodied directly in hardware, in a software module executed by a processor, or in a combination of the two. A software module may reside in any form of storage medium that is known in the art. Some examples of storage media that may be used include random access memory (RAM), read only memory (ROM), flash memory, EPROM memory, EEPROM memory, registers, a hard disk, a removable disk, a CD-ROM and so forth. A software module may comprise a single instruction, or many instructions, and may be distributed over several different code segments, among different programs, and across multiple storage media. A storage medium may be coupled to a processor such that the processor can read information from, and write information to, the storage medium. In the alternative, the storage medium may be integral to the processor.

The functions described may be implemented in hardware, software, firmware, or any combination thereof. If implemented in hardware, an example hardware configuration may comprise a processing system in a wireless node. The processing system may be implemented with a bus architecture. The bus may include any number of interconnecting buses and bridges depending on the specific application of the processing system and the overall design constraints. The bus may link together various circuits including a processor, machine-readable media, and a bus interface. The bus interface may be used to connect a network adapter, among other things, to the processing system via the bus. The network adapter may be used to implement the signal processing functions of the PHY layer. In the case of a user terminal, a user interface (e.g., keypad, display, mouse, joystick, etc.) may also be connected to the bus. The bus may also link various other circuits such as timing sources, peripherals, voltage regulators, power management circuits, and the like, which are well known in the art, and therefore, will not be described any further.

A processor may be responsible for managing the bus and general processing, including the execution of software stored on the machine-readable media. The processor may be implemented with one or more general-purpose and/or special-purpose processors. Examples include microprocessors, microcontrollers, DSP processors, and other circuitry that can execute software. Software shall be construed broadly to mean instructions, data, or any combination thereof, whether referred to as software, firmware, middleware, microcode, hardware description language, or otherwise. Machine-readable media may include, by way of example, RAM (Random Access Memory), flash memory, ROM (Read Only Memory), PROM (Programmable Read-Only Memory), EPROM (Erasable Programmable Read-Only Memory), EEPROM (Electrically Erasable Programmable Read-Only Memory), registers, magnetic disks, optical disks, hard drives, or any other suitable storage medium, or any combination thereof. The machine-readable media may be embodied in a computer-program product. The computer-program product may comprise packaging materials.

In a hardware implementation, the machine-readable media may be part of the processing system separate from the processor. However, as those skilled in the art will readily appreciate, the machine-readable media, or any portion thereof, may be external to the processing system. By way of example, the machine-readable media may include a transmission line, a carrier wave modulated by data, and/or a computer product separate from the wireless node, all which may be accessed by the processor through the bus interface. Alternatively, or in addition, the machine-readable media, or any portion thereof, may be integrated into the processor, such as the case may be with cache and/or general register files.

The processing system may be configured as a general-purpose processing system with one or more microprocessors providing the processor functionality and external memory providing at least a portion of the machine-readable media, all linked together with other supporting circuitry through an external bus architecture. Alternatively, the processing system may be implemented with an ASIC (Application Specific Integrated Circuit) with the processor, the bus interface, the user interface in the case of an access terminal), supporting circuitry, and at least a portion of the machine-readable media integrated into a single chip, or with one or more FPGAs (Field Programmable Gate Arrays), PLDs (Programmable Logic Devices), controllers, state machines, gated logic, discrete hardware components, or any other suitable circuitry, or any combination of circuits that can perform the various functionality described throughout this disclosure. Those skilled in the art will recognize how best to implement the described functionality for the processing system depending on the particular application and the overall design constraints imposed on the overall system.

The machine-readable media may comprise a number of software modules. The software modules include instructions that, when executed by the processor, cause the processing system to perform various functions. The software modules may include a transmission module and a receiving module. Each software module may reside in a single storage device or be distributed across multiple storage devices. By way of example, a software module may be loaded into RAM from a hard drive when a triggering event occurs. During execution of the software module, the processor may load some of the instructions into cache to increase access speed. One or more cache lines may then be loaded into a general register file for execution by the processor. When referring to the functionality of a software module below, it will be understood that such functionality is implemented by the processor when executing instructions from that software module.

If implemented in software, the functions may be stored or transmitted over as one or more instructions or code on a computer-readable medium. Computer-readable media include both computer storage media and communication media including any medium that facilitates transfer of a computer program from one place to another. A storage medium may be any available medium that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared (IR), radio, and microwave, then the coaxial cable, fiber optic cable, twisted pair, DSL, or wireless technologies such as infrared, radio, and microwave are included in the definition of medium. Disk and disc, as used herein, include compact disc (CD), laser disc, optical disc, digital versatile disc (DVD), floppy disk, and Blu-ray® disc where disks usually reproduce data magnetically, while discs reproduce data optically with lasers. Thus, in some aspects computer-readable media may comprise non-transitory computer-readable media (e.g., tangible media). In addition, for other aspects computer-readable media may comprise transitory computer-readable media (e.g., a signal). Combinations of the above should also be included within the scope of computer-readable media.

Thus, certain aspects may comprise a computer program product for performing the operations presented herein. For example, such a computer program product may comprise a computer-readable medium having instructions stored (and/ or encoded) thereon, the instructions being executable by one or more processors to perform the operations described herein. For certain aspects, the computer program product may include packaging material.

Further, it should be appreciated that modules and/or other appropriate means for performing the methods and techniques described herein can be downloaded and/or otherwise obtained by a user terminal and/or base station as applicable. For example, such a device can be coupled to a server to facilitate the transfer of means for performing the methods described herein. Alternatively, various methods described herein can be provided via storage means (e.g., RAM, ROM, a physical storage medium such as a compact disc (CD) or floppy disk, etc.), such that a user terminal and/or base station can obtain the various methods upon coupling or providing the storage means to the device. Moreover, any other suitable technique for providing the methods and techniques described herein to a device can be utilized.

As described herein, a wireless device/node in the disclosure set forth herein may include various components that perform functions based on signals that are transmitted by or received at the wireless device. A wireless device may also refer to a wearable wireless device. In some aspects the wearable wireless device may comprise a wireless headset or a wireless watch. For example, a wireless headset may include a transducer adapted to provide audio output based on data received via a receiver. A wireless watch may include a user interface adapted to provide an indication based on data received via a receiver. A wireless sensing device may include a sensor adapted to provide data to be transmitted via a transmitter.

A wireless device may communicate via one or more wireless communication links that are based on or otherwise support any suitable wireless communication technology. For example, in some aspects a wireless device may associate with a network. In some aspects the network may comprise a personal area network (e.g., supporting a wireless coverage area on the order of 30 meters) or a body area network (e.g., supporting a wireless coverage area on the order of 30 meters) implemented using ultra-wideband technology or some other suitable technology. In some aspects the network may comprise a local area network or a wide area network. A wireless device may support or otherwise use one or more of a variety of wireless communication technologies, protocols, or standards such as, for example, CDMA, TDMA, OFDM, OFDMA, WiMAX, and Wi-Fi. Similarly, a wireless device may support or otherwise use one or more of a variety of corresponding modulation or multiplexing schemes. A wireless device may thus include appropriate components (e.g., air interfaces) to establish and communicate via one or more wireless communication links using the above or other wireless communication technologies. For example, a device may comprise a wireless transceiver with associated transmitter and receiver components (e.g., transmitter 410 and receiver 412) that may include various components (e.g., signal generators and signal processors) that facilitate communication over a wireless medium.

The teachings herein may be incorporated into (e.g., implemented within or performed by) a variety of apparatuses (e.g., devices). For example, one or more aspects taught herein may be incorporated into a phone (e.g., a cellular phone), a personal data assistant ("PDA") or so-called smart-phone, an entertainment device (e.g., a portable media device, including music and video players), a headset (e.g., headphones, an earpiece, etc.), a microphone, a medical sensing device (e.g., a biometric sensor, a heart rate monitor, a pedometer, an EKG device, a smart bandage, etc.), a user I/O device (e.g., a watch, a remote control, a light switch, a keyboard, a mouse, etc.), an environment sensing device (e.g., a tire pressure monitor), a monitoring device that may receive data from the medical or environment sensing device (e.g., a desktop, a mobile computer, etc.), a point-of-care device, a hearing aid, a set-top box, or any other suitable device. The monitoring device may also have access to data from different sensing devices via connection with a network. These devices may have different power and data requirements. In some aspects, the teachings herein may be adapted for use in low power applications (e.g., through the use of an impulse-based signaling scheme and low duty cycle modes) and may support a variety of data rates including relatively high data rates (e.g., through the use of high-bandwidth pulses).

In some aspects a wireless device may comprise an access device (e.g., an access point) for a communication system. Such an access device may provide, for example, connectivity to another network (e.g., a wide area network such as the Internet or a cellular network) via a wired or wireless communication link. Accordingly, the access device may enable another device (e.g., a wireless station) to access the other network or some other functionality. In addition, it should be appreciated that one or both of the devices may be portable or, in some cases, relatively non-portable. Also, it should be appreciated that a wireless device also may be capable of transmitting and/or receiving information in a non-wireless manner (e.g., via a wired connection) via an appropriate communication interface.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. An apparatus for remote control by a remote object comprising:

one or more sensors configured to communicate with at least one sensor in a body area network at the remote object to obtain: (1) ranging information of the apparatus relative to the remote object, and (2) commands generated from the body area network by a remote object processing system; and a processing system configured to, based on the ranging information, autonomously switch between two modes comprising a first mode to perform the commands received from the remote object; and a second mode to provide local control of the apparatus, wherein the processing system autonomously switches to the second mode such that the local control of the apparatus is provided by the processing system in response to the processing system determining that the apparatus is outside a communication range with the remote object.

2. The apparatus of claim 1, wherein the processing system is further configured to autonomously switch to the second mode and disable remote control of the apparatus if the ranging information reaches a threshold.

3. The apparatus of claim 1, wherein the processing system is further configured to autonomously switch to the first mode and enable remote control of the apparatus if the ranging information reaches a threshold.

4. The apparatus of claim 1, wherein the processing system is further configured to provide the local control of the apparatus to modify a position of the apparatus if the ranging information reaches a threshold.

5. The apparatus of claim 4, wherein the processing system is further configured to modify the position of the apparatus to allow remote control of the apparatus.

6. The apparatus of claim 1, wherein the one or more sensors includes one of at least a proximity sensor and/or inertial sensor.

7. The apparatus of claim 1, wherein the remote object is a mobile device.

8. The apparatus of claim 1, wherein the remote object is configured to provide augmented reality game play.

9. The apparatus of claim 1, wherein the commands obtained from the remote object are based on one or more gestures sensed by the body area network.

10. The apparatus of claim 9, wherein the commands obtained from the remote object are generated by the remote object processing system from the one or more gestures sensed by the body area network.

11. An apparatus for remote control by a remote object comprising:

one or more means for sensing configured to communicate with at least one sensor in a body area network at the remote object to obtain: (1) ranging information of the apparatus relative to the remote object, and (2) commands generated from the body area network by a remote object processing system; and a means for processing configured to, based on the ranging information, autonomously switch between two modes comprising a first mode to perform the commands obtained from the remote object; and a second mode to provide local control of the apparatus wherein the means for processing autonomously switches to the second mode such that the local control of the apparatus is provided by the means for processing when in response to the means for processing determining that the apparatus is outside a communication range with the remote object.

12. The apparatus of claim 11, wherein the means for processing is further configured to autonomously switch to the second mode and disable remote control of the apparatus if the ranging information reaches a threshold.

13. The apparatus of claim 11, wherein the means for processing is further configured to autonomously switch to the first mode and enable remote control of the apparatus if the ranging information reaches a threshold.

14. The apparatus of claim 11, wherein the means for processing is further configured to provide the local control of the apparatus to modify a position of the apparatus if the ranging information reaches a threshold.

15. The apparatus of claim 14, wherein the means for processing is further configured to modify the position of the apparatus to allow remote control of the apparatus.

16. The apparatus of claim 11, wherein the one or more means for sensing includes one of at least a proximity sensor and/or inertial sensor.

17. The apparatus of claim 11, wherein the remote object is a mobile device.

18. The apparatus of claim 11, wherein the remote object is configured to provide augmented reality game play.

19. The apparatus of claim 11, wherein the commands obtained from the remote object are based on one or more gestures sensed by the body area network.

20. The apparatus of claim 19, wherein the commands obtained from the remote object are generated by the remote object processing system from the one or more gestures sensed by the body area network.

21. A method for remote control of an apparatus by a remote object comprising:

communicating via one or more sensors of the apparatus with at least one sensor in a body area network at the remote object to obtain: (1) ranging information of the apparatus relative to the remote object, and (2) commands generated from the body area network by a remote object processing system, wherein the communicating is performed by the apparatus; and based on the ranging information, a processing system of the apparatus autonomously switching between at least one of two modes comprising a first mode to perform the commands obtained from the remote object; and a second mode to provide local control of the apparatus, wherein the processing system autonomously switches to the second mode such that the local control of the apparatus is provided by the processing system in response to the processing system determining that the apparatus is outside a communication range with the remote object.

22. The method of claim 21, further comprising autonomously switching to the second mode and disabling remote control of the apparatus if the ranging information reaches a threshold.

23. The method of claim 21, further comprising autonomously switching to the first mode and enabling remote control of the apparatus if the ranging information reaches a threshold.

24. The method of claim 21, further comprising providing the local control of the apparatus to modify a position of the apparatus if the ranging information reaches a threshold.

25. The method of claim 24, further comprising modifying the position of the apparatus to allow remote control of the apparatus.

26. The method of claim 21, wherein the ranging information is obtained from one or more sensors that include one of at least a proximity sensor and/or inertial sensor.

27. The method of claim 21, wherein the remote object is a mobile device.

28. The method of claim 21, wherein the remote object is configured to provide augmented reality game play.

29. The method of claim 21, wherein the commands obtained from the remote object are based on one or more gestures sensed by the body area network.

30. The method of claim 29, wherein the commands obtained from the remote object are generated by the remote object processing system from the one or more gestures sensed by the body area network.

31. A computer program product for remote control of an apparatus by a remote object comprising:

a non-transitory computer-readable storage medium comprising instructions executable for:

communicating via one or more sensors of the apparatus with at least one sensor in a body area network at the remote object to obtain: (1) ranging information of the apparatus relative to the remote object, and (2) commands generated from the body area network by a remote object processing system, and based on the ranging information, a processing system of the apparatus autonomously switching between two modes comprising a first mode to perform the commands obtained from the remote object; and a second mode to provide local control of the apparatus and autonomously switching to the second mode such that the local control is provided by the processing system response to determining that the apparatus is outside a communication range with the remote object.

32. The computer program product of claim 31, wherein the non-transitory computer-readable storage medium further comprises instructions executable for autonomously switching to the second mode and disabling remote control of the apparatus if the ranging information reaches a threshold.

33. The computer program product of claim 31, wherein the non-transitory computer-readable storage medium further comprises instructions executable for autonomously switching to the first mode and enabling remote control of the apparatus if the ranging information reaches a threshold.

34. The computer program product of claim 31, wherein the non-transitory computer-readable storage medium further comprises instructions executable for providing the local control of the apparatus to modify a position of the apparatus if the ranging information reaches a threshold.

35. The computer program product of claim 34, wherein the non-transitory computer-readable storage medium further comprises instructions executable for modifying the position of the apparatus to allow remote control of the apparatus.

36. The computer program product of claim 31, wherein the ranging information is obtained from one or more sensors that include one of at least a proximity sensor and/or inertial sensor.

37. The computer program product of claim 31, wherein the remote object is a mobile device.

38. The computer program product of claim 31, wherein the remote object is configured to provide augmented reality game play.

39. The computer program product of claim 31, wherein the commands obtained from the remote object are based on one or more gestures sensed by the body area network.

40. The computer program product of claim 39, wherein the commands obtained from the remote object are generated by the remote object processing system from the one or more gestures sensed by the body area network.

41. A remote control vehicle for remote control by a remote object comprising:

at least one antenna;

one or more sensors configured to communication with at least one sensor in a body area network at with the remote object using the at least one antenna to obtain: (1) ranging information of the remote control vehicle relative to the remote object, and (2) commands generated from the body area network by a remote object processing system; and a processing system configured to, based on the ranging information, autonomously switch between two modes comprising a first mode to perform the commands obtained from the remote object; and a second mode to provide local control of the remote control vehicle, wherein the processing system autonomously switches to the second mode such that the local control of the remote control vehicle is provided by the processing system in response to the processing system determining that the remote control vehicle is outside a communication range with the remote object.

42. The remote control vehicle of claim 41, wherein the one or more sensors includes one of at least a proximity sensor and/or inertial sensor.

43. The remote control vehicle of claim 41, wherein the remote object is a mobile device.

44. The remote control vehicle of claim 41, wherein the remote object is configured to provide augmented reality game play.

45. The remote control vehicle of claim 41, wherein the processing system is further configured to autonomously switch to the first mode to re-enable the remote control of the remote control vehicle to modify a position of the remote control vehicle if the ranging information reaches a threshold to allow the remote control of the remote control vehicle.

46. The remote control vehicle of claim 41, wherein the commands obtained from the remote object are based on one or more gestures sensed by the body area network.

47. The remote control vehicle of claim 46, wherein the commands obtained from the remote object are generated by the remote object processing system from the one or more gestures sensed by the body area network.

* * * * *